United States Patent [19]

Kim

[11] Patent Number: 4,782,556

[45] Date of Patent: Nov. 8, 1988

[54] HANDLE FOR LUGGAGE CASE

[75] Inventor: Hyun S. Kim, New Castle, Pa.

[73] Assignee: Airway Industries, Inc., Ellwood City, Pa.

[21] Appl. No.: 68,120

[22] Filed: Jun. 29, 1987

[51] Int. Cl.[4] ..... A45C 13/26

[52] U.S. Cl. ..... 16/125; 150/110; 190/39; 190/115

[58] Field of Search ..... 16/115, 124, 125; 150/107, 110; 190/39, 115

[56] References Cited

U.S. PATENT DOCUMENTS

| | | | |
|---|---|---|---|
| 195,132 | 9/1877 | Hopfensack | 150/110 |
| 778,060 | 12/1904 | Moore | 190/115 |
| 2,706,024 | 4/1955 | Kish, Jr. | 190/115 |
| 3,425,470 | 9/1967 | Wuest | 150/30 |
| 3,700,160 | 10/1972 | Farrell | 229/34 R |
| 3,736,621 | 8/1971 | Szabo | 16/116 |
| 4,134,480 | 1/1979 | Davis | 16/115 |
| 4,696,077 | 9/1987 | Kim | 16/125 |

FOREIGN PATENT DOCUMENTS

| | | | |
|---|---|---|---|
| 229513 | 9/1963 | Austria | 190/115 |
| 2937786 | 4/1981 | Fed. Rep. of Germany . | |

*Primary Examiner*—Fred A. Silverberg
*Assistant Examiner*—Edward A. Brown
*Attorney, Agent, or Firm*—Walter J. Blenko, Jr.; Suzanne Kikel

[57] ABSTRACT

A handle for a luggage case made of two longitudinal spaced apart rows of heavy cord of twisted material with an outer piece of fabric material folded longitudinally around the two rows and sewn along a longitudinal centerline to form a strap. The cords are centrally located and of a length such that it determines the length of the handle and forms a substantially rigid, padded central portion of the handle. The opposite ends of the formed strap are free of the corded fabric, are slid through attachment loops, and folded under until the ends substantially come together thereby forming a lower and upper layer for the handle. A sleeve is wrapped around the juncture of the ends, and both upper and lower layers are fixed together.

3 Claims, 2 Drawing Sheets

HANDLE FOR LUGGAGE CASE

BACKGROUND OF THE INVENTION

1. Field of the Invention

This invention relates to a handle for a luggage case, and a method for making such a handle, which handle is flexibly deformable into an arched or curved semi-rigid contour for use in carrying a luggage case.

2. Description of the Prior Art

Handles for luggage cases are customarily of a rigid arched or curved contour convenient for the grasp of the hand of the user or carrier. Sometimes the handle is padded or of a resilient material or composition to protect the hands of the carrier. Alternately the handle is made entirely of an outer layer of leather or vinyl which may tend to cause the hand to sweat under prolonged periods of use. The folding and stitching of the material of the handle may be such as to be uncomfortable and/or irritating to the hands and fingers under heavy loads and/or extended periods of use.

Examples of such a handle may be shown in U.S. Pat. Nos. 778,060; 3,736,621; and 4,134,480; in the applicant's patent application Ser. No. 868,099 filed on May 29, 1986 now U.S. Pat. No. 4,696,077; or in German Patent No. DE2937-786 filed Sept. 19, 1979 by Steinmann.

SUMMARY OF THE INVENTION

It is an object of my present invention to provide a handle for a luggage case and a method of making such a handle, which handle is easy and inexpensive to manufacture, and has a substantially sturdy central portion which is easily grippable, relatively smooth, and comfortable for the carrier.

More specifically, I provide a handle for a luggage case which comprises a single strap of composite construction made of an elongated piece of outer interwoven absorbing material enwrapped around two spaced apart distinct rows of a heavy cord of fiber which are longitudinally coextensive with the outer piece, and centrally arranged such as to give the handle its foundation and contour which can be easily and comfortably grasped by the hand. The length of the corded material determines the length for the handle and the piece of outer interwoven material is first folded longitudinally into thirds and then its opposite ends are folded back along a central portion of the strap to form a double layer strap and to form elongated slots for retaining coupling loops used to attach the handle to the frame or body of the luggage case. When folded back on itself, the opposite ends of the formed strap are caused to substantially come together, and are inserted in a sleeve which enwraps the juncture of the two strap ends. The top layer of the strap may be sewn to the bottom layer via the sleeve. Optionally, a decorative strip may be sewn along the strap when in its fully extended longitudinal positioning prior to the ends being slid through their respective loops and folded on the central portion for attachment of the loops. This decorative strip extends across the top, around the ends, and on the underside of the handle beneath the sleeve.

The above described and other details of the handle and method of making the handle of the present invention will become apparent in the description of a preferred embodiment herein after fully set forth, when read in connection with the accompanying drawings attached hereto.

DESCRIPTION OF THE PREFERRED EMBODIMENT

Figure 1:
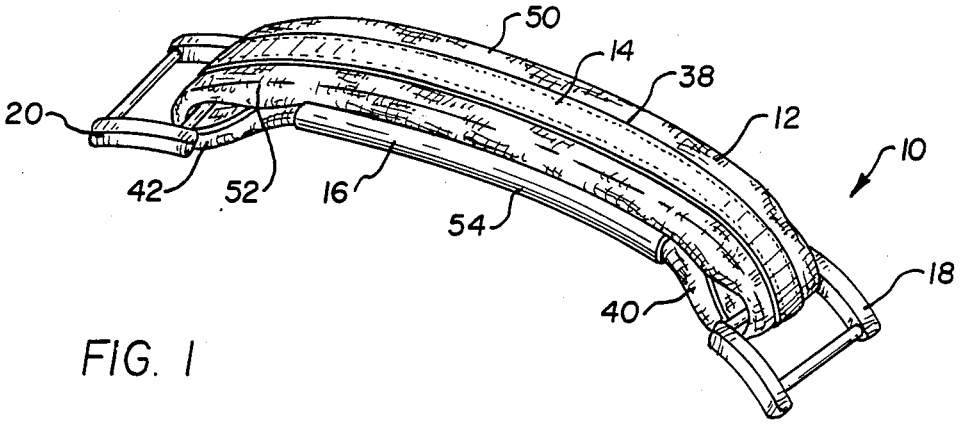
FIG. 1 is an isometric view of a formed handle of the present invention.
Figure 2:
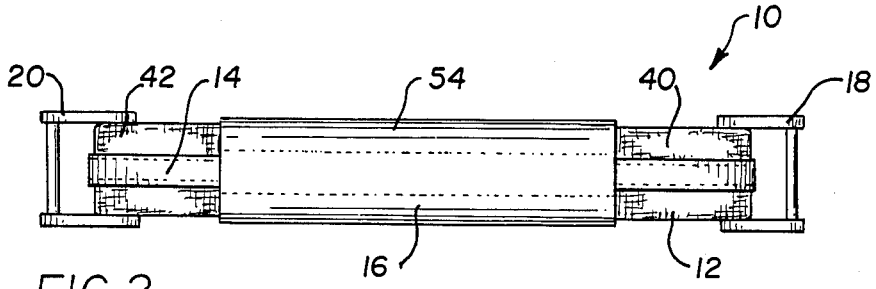
FIG. 2 is a bottom view of a formed handle of the present invention.

Referring first to FIGS. 1 and 2 there is shown handle 10 comprising a double layer strap 12, a decorative strip 14, and a sleeve 16. Loops 18 and 20 are not part of the invention, and are used in a conventional manner to attach handle 10 to a frame or body of a luggage case (not shown).

The construction and components of handle 10 will be explained in detail with particular reference to FIGS. 3–6. Strap 12 comprises an elongated piece of material or webbing 22, and two rows of spaced apart, parallelly arranged pieces of twisted material or heavy cords 24 and 26. These cords 24, 26 are of the same length relative to each other and are longitudinally coextensive with and centrally disposed on an inner surface 28 of webbing 22 when webbing 22 is in a flattened condition particularly shown in FIGS. 3 and 4. Cords 24 and 26 are shorter than webbing 22, with their lengths being selected such as to be approximately the desired length for handle 10 of FIGS. 1 and 2.

Figure 3:
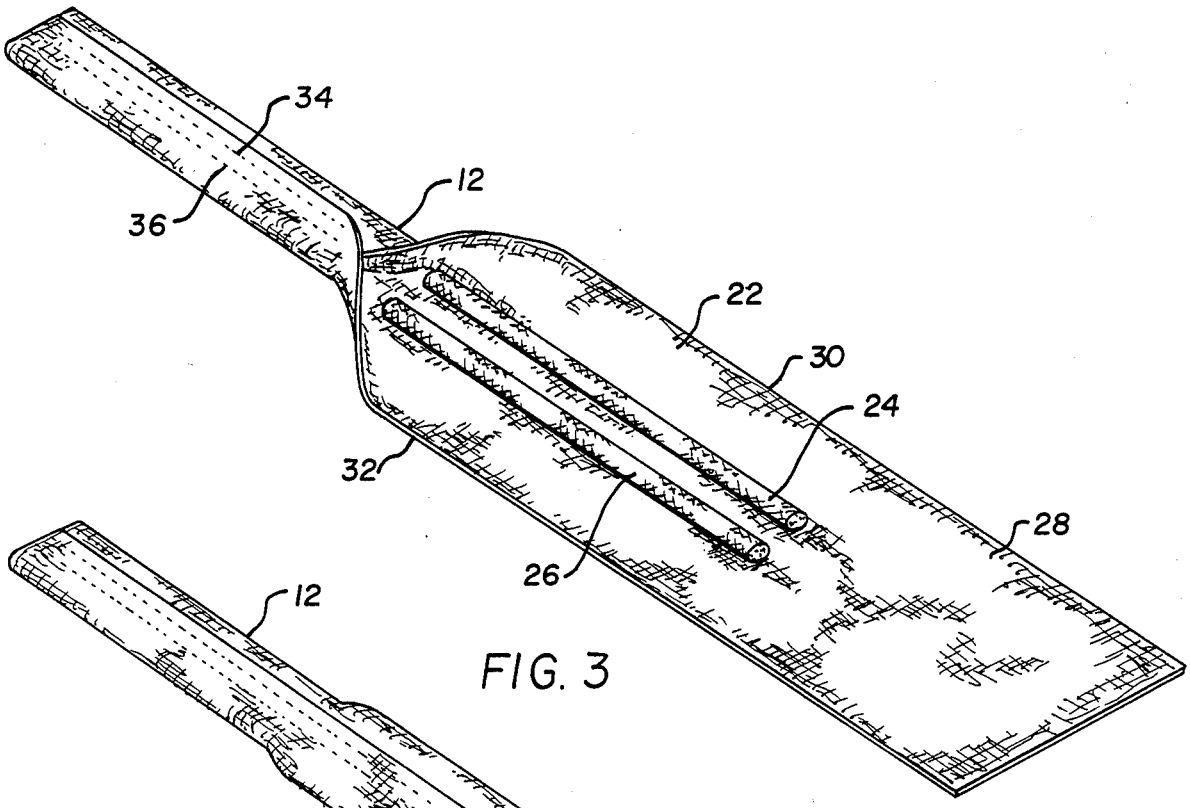
FIG. 3 is an isometric view illustrating a strap which is partially formed, and a first step in constructing the strap thereof.
Figure 4:
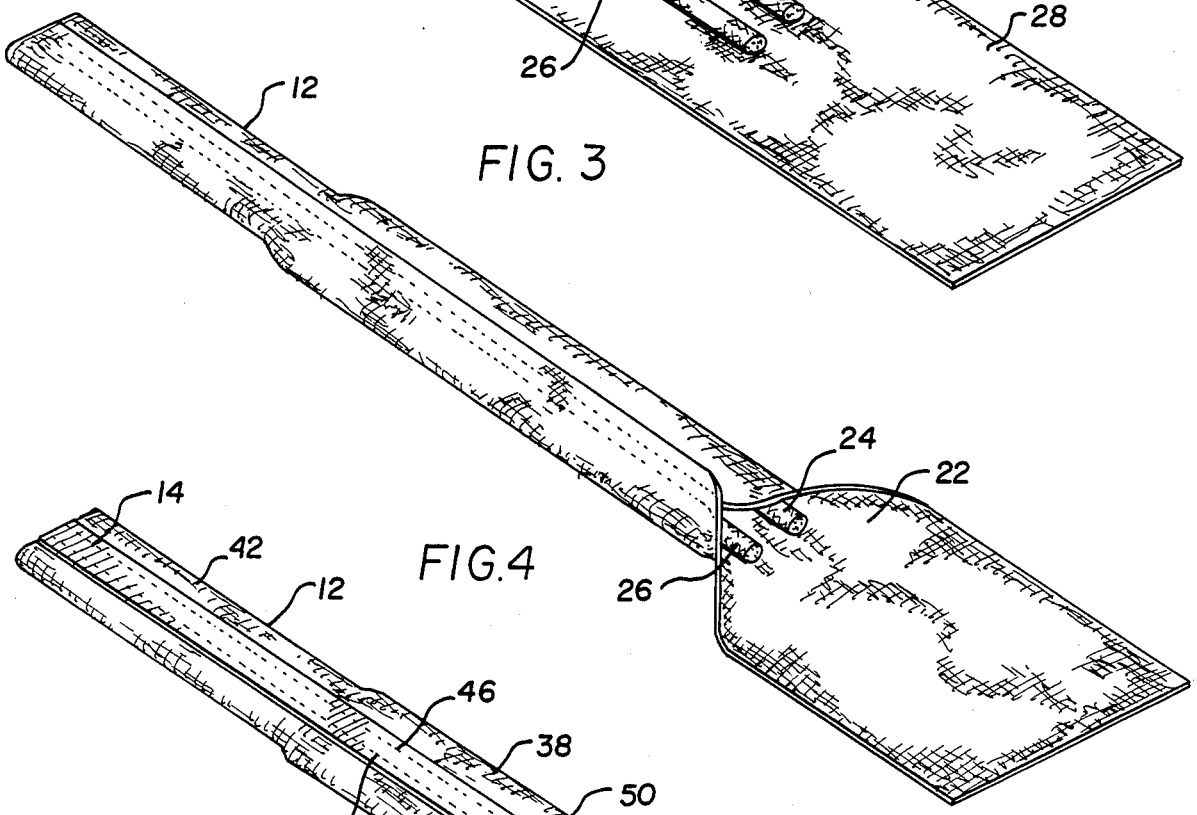
FIG. 4 is an isometric view illustrating an additional phase of the step of FIG. 3.

Still referring to FIGS. 3 and 4, in order to form strap 12, webbing 22 is folded in thirds by first folding longitudinal edge 30 and then folding longitudinal edge 32 over edge 30. This is done for the entire length of webbing 22 so that cords 24 and 26 are completely enclosed by webbing 12. FIG. 4 particularly shows the webbing 22 as being folded over cords 24 and 26, and FIG. 5 shows cords 24 and 26 as being completely covered by webbing 22.

Figure 5:
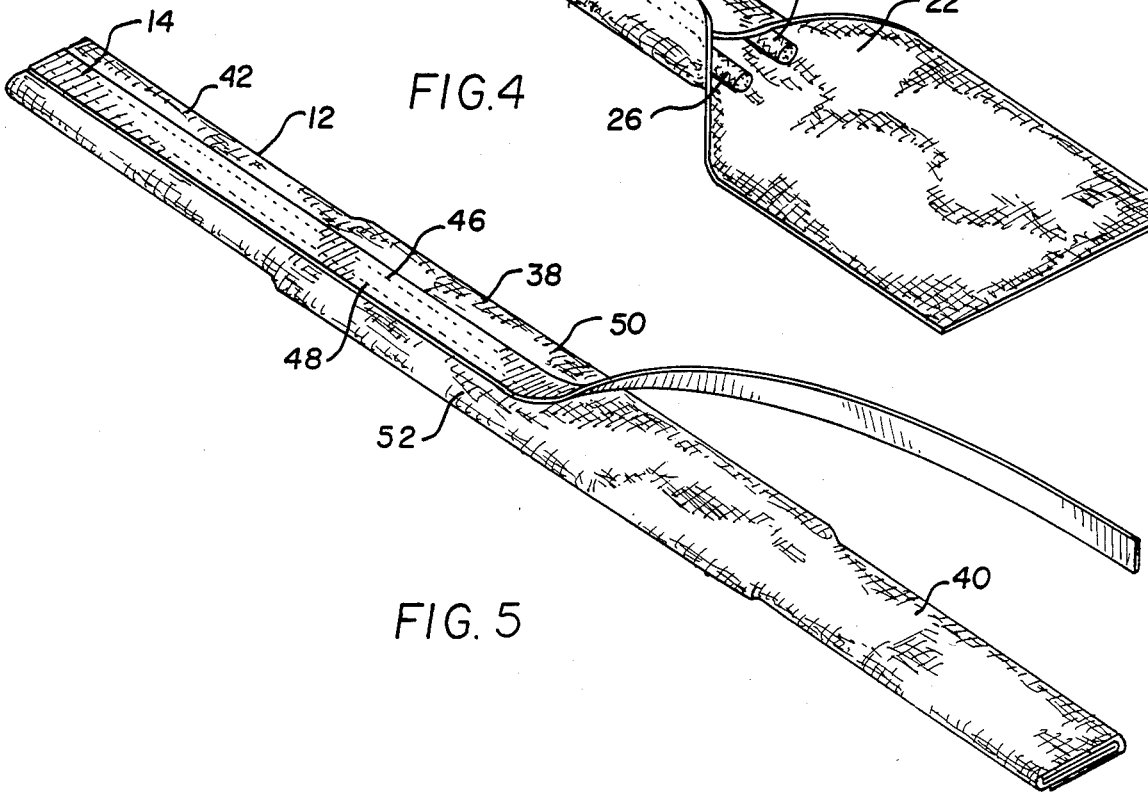
FIG. 5 is an isometric view illustrating a decorative strip optionally chosen in the construction of a strap for a handle of FIG. 1.

Preferably, one or two rows of stitches as shown at 34 and 36 to the far left of FIGS. 3 and 4 are made down along the longitudinal centerline of strap 12 between the two rows of cords 24 and 26 so that cords 24 and 26 are disposed opposite each other along the length of strap 12 to form a wider center portion 38 in comparison with the narrower opposite end portions 40 and 42 of strap 12 as particularly seen in FIG. 5.

Figure 6:
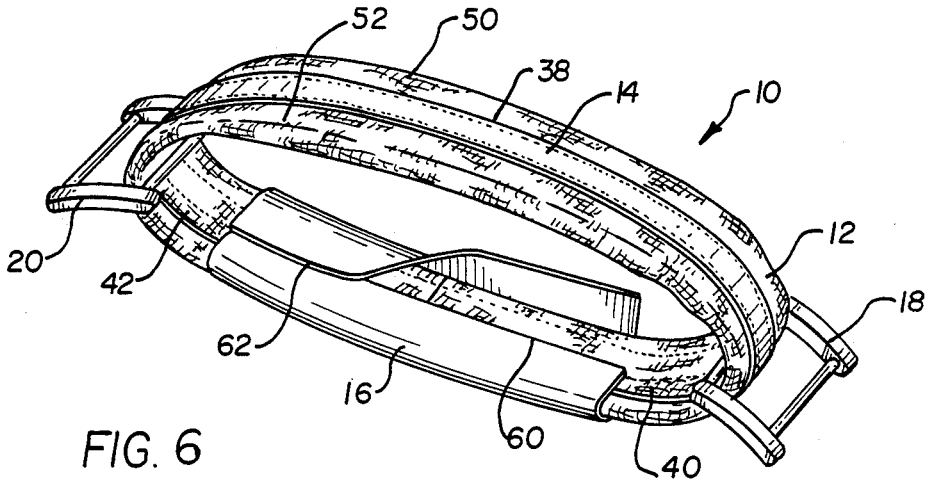
FIG. 6 is an isometric view illustrating an additional step in constructing a handle of FIG. 1.

As seen in FIG. 5, strip 14 is positioned on a surface 44 of strap 14 opposite to that shown in FIGS. 3 and 4, which surface is to become a top surface for handle 10 of FIGS. 1, 2, and 6. Decorative strip 14 is sewn between cords 24 and 26 on the top surface, preferably by two longitudinal rows of stitches 46 and 48 extending down through webbing 22 to cause cords 24 and 26 to form protrusions 50 and 52.

FIG. 6 illustrates the manner in which loops 18 and 20 are affixed to strap 12. This is accomplished by sliding each of the opposite end portions 40 and 42 of strap 12 as shown in FIG. 5 in its respective loop 18 and 20, and folding these end portions 40, 42 underneath center portion 38 to the extent that end portions 40 and 42 either meet or substantially come together to form a bottom layer with center portion 38 forming an upper layer for handle 10.

In still referring to FIG. 6, end portions 40 and 42 are permanently joined together by sleeve 16 consisting of a piece of material which is wrapped around end portions 40, 42 so that its longitudinal edges 60 and 62 overlap to form sleeve 16 around the lower layer of strap 12. Optionally, sleeve 16 may be preformed and end portions 40 and 42 inserted therein. Preferably, sleeve 16 may be made of leather and affixed to the lower layer by stitches (not shown). As shown in FIGS. 1 and 2, when strip 14 is fixed on top of webbing 22 and when end portions 40, 42 are folded under center portion 38 of strap 12, strip 14 extends around and underneath end portions 40 and 42, and are enclosed by sleeve 16. As a final step, the lower layer of strap 12 is attached to its upper layer through suitable means, such as stitching or gluing, to form the necessary slots for retaining loops 18 and 20 in place as shown in FIGS. 1 and 2.

It is to be noted that strap 12 may be of an interwoven, absorbing material and that decorative strip 14 may be made of leather or of a material corresponding in resiliency, color, and texture to that of sleeve 16. In sewing the several pieces 12, 14, and 16 together, especially in view of the rows of stitches along the longitudinal centerline, an indentation is formed therealong particularly on top of handle 10 with protrusions 50 and 52 formed along the indentation. The constructed handle 10 of FIGS. 1 and 2 is caused to assume a substantially flat disposition with protrusions 50 and 52 relatively maintaining a definite contour. The width of handle 10 is wide enough to be encircled by an average dimension hand span with gripping action being provided by the indentation, the surface of sleeve, and the thickness or padding of strap 12 and sleeve 54.

Handle 10 is substantially flexible thereby permitting the necessary arching away from the luggage case for easy grasping. The contour of handle 10 adds ease in carrying the luggage case, or the like to which handle 10 is attached. The fabric materials of handle 10 are all of a sturdy, durable nature adding extended life thereto in addition to enhancing both the beauty and durability of the frame or body to which handle 10 is affixed.

While a specific embodiment 3 of handle 10 is disclosed and described herein, it will be understood that further variations therefrom are possible within the scope of the following claims.

I claim:

1. In a handle assembly for a luggage case of the type in which a handle is attached to the body of the luggage case by a loop located at each end of said handle, said handle comprising:

strap means having a central portion and two opposed end portions, each said end portion being adjacent said central portion and extended through a respective said loop and folded under said central portion to an extent that said central portion becomes a first layer for said strap and said end portions substantially come together to form a second layer for said strap with slots for said respective loop, strip means attached along a longitudinal centerline on an outer surface of said strap means and extended along said first layer, around said folded end portions, and along a bottom surface of said second layer of said strap means, and sleeve means arranged around said end portions and generally centrally located and substantially extending the length of only said second layer.

2. In a handle assembly for a luggage case of the type in which a handle is attached to the body of the luggage case by a loop located at each end of said handle, said handle comprising:

strap means having a central portion and two opposed end portions, each said end portion being adjacent said central portion and extended through a respective said loop and folded under said central portion to an extent that said central portion becomes a first layer for said strap and said end portions abut each other to form a second layer for said strap with slots for said respective loop, said strap means further including two spaced-apart rows of corded fabric having the same length relative to each other, which length is substantially the same dimension as the length of said first layer for said strap, an outer piece of material folded over itself longitudinally to enwrap said two rows of corded fabric to form opposed longitudinal protrusions on said first layer of said strap, and means for securing each said row of corded fabric in place in said folded material, a sleeve arranged around said abutting end portions and substantially extending the length of said second layer of said strap means, and means for attaching said first layer and said second layer of said strap with said sleeve together.

3. In a handle assembly for a luggage case of the type in which a handle is attached to the body of the luggage case by a loop located at each end of said handle, said handle comprising:

strap means having a central portion and two opposed end portions, each said end portion being adjacent said central portion and extended through a respective said loop and folded under said central portion to an extent that said central portion becomes a first layer for said strap and said end portions abut each other to form a second layer for said strap with slots for said respective loop, said strap means further including two spaced-apart rows of corded fabric having the same length relative to each other, which length is substantially the same dimension as the length of said first layer for said strap, an outer piece of material folded over itself longitudinally to enwrap said two rows of corded fabric to form opposed longitudinal protrusions on said first layer of said strap, and means for securing each said row of corded fabric in place in said folded material whereby a wider said central portion in comparison to said opposed end portions is formed, strip means attached along a longitudinal centerline on an outer surface of said strap means and extended along said only first layer, around said folded end portions, and along a bottom surface of said second layer of said strap means, and a sleeve arranged around said abutting end portions and substantially extending the length of said second layer of said strap means, and means for attaching said first layer and said second layer of said strap with said sleeve together.

* * * * *

UNITED STATES PATENT AND TRADEMARK OFFICE

CERTIFICATE OF CORRECTION

PATENT NO. : 4,782,556

DATED : November 8, 1988

INVENTOR(S) : Hyun S. Kim

It is certified that error appears in the above-identified patent and that said Letters Patent is hereby corrected as shown below:

Claim 3, line 59, after "said" (first occurrence), delete "only"; line 63, after "said" insert --only--.

Signed and Sealed this

Fourteenth Day of March, 1989

*Attest:*

*Attesting Officer*

DONALD J. QUIGG

*Commissioner of Patents and Trademarks*